US011274392B2

(12) United States Patent
Castello

(10) Patent No.: US 11,274,392 B2
(45) Date of Patent: Mar. 15, 2022

(54) SUITCASE-INTEGRATED DRYING SYSTEM

(71) Applicant: Pat Anthony Castello, Anchorage, AK (US)

(72) Inventor: Pat Anthony Castello, Anchorage, AK (US)

( * ) Notice: Subject to any disclaimer, the term of this patent is extended or adjusted under 35 U.S.C. 154(b) by 389 days.

(21) Appl. No.: 16/665,861

(22) Filed: Oct. 28, 2019

(65) Prior Publication Data

US 2021/0123182 A1 Apr. 29, 2021

(51) Int. Cl.
*D06F 58/12* (2006.01)
*D06F 58/14* (2006.01)
*D06F 57/12* (2006.01)

(52) U.S. Cl.
CPC ..... *D06F 58/12* (2013.01); *D06F 57/12* (2013.01); *D06F 58/14* (2013.01)

(58) Field of Classification Search
CPC ..... D06F 58/12; D06F 58/14; D06F 57/12
USPC ..... 34/90
See application file for complete search history.

(56) References Cited

U.S. PATENT DOCUMENTS 2,328,129 A * 8/1943 Guyon ..... A47L 15/48 34/90
2,549,106 A * 4/1951 Manacheralfredt ... F24H 3/0417 34/90
2,701,921 A 2/1955 Strongson
3,280,477 A * 10/1966 Rawlins ..... D06F 58/14 34/622
3,576,079 A 4/1971 Hauser
3,577,650 A 5/1971 Brahm
4,180,919 A * 1/1980 Baltes ..... D06F 58/10 34/449
5,555,640 A * 9/1996 Ou ..... F26B 25/066 34/202
5,642,572 A 7/1997 Manning
5,755,040 A * 5/1998 Ou ..... D06F 58/10 34/202
7,941,936 B2 5/2011 Mangano
10,668,443 B2 * 6/2020 Kuppler ..... F27B 1/00
10,774,462 B2 * 9/2020 Ayers ..... D06F 60/00
(Continued)

FOREIGN PATENT DOCUMENTS

CA 2883555 A1 * 8/2016 ..... D06F 58/12
JP 3156215 U * 12/2009 ..... D06F 58/10
(Continued)

*Primary Examiner* — Stephen M Gravini

(57) ABSTRACT

A suitcase-integrated drying system is an apparatus that effectively dries clothing while remaining portable and compact throughout transportation. The apparatus includes a suitcase, a rack system, a dryer system, and a drainage system. The suitcase contains travel items as well as the rack system, the dryer system, and the drainage system. The rack system upholds and suspends clothing above the dryer system. The rack system is extendable and retractable with the dryer system. The dryer system directs heated air to the clothing hung with the rack system. The dryer system provides a continuous flow of heated air towards the clothing. The dryer system preferably includes a rack cover as well to further contain the heated air around the clothing, further facilitating the drying of the clothing. The drainage system collects any drippings from the wet clothing being dried and preserves the integrity of the suitcase throughout the drying process.

20 Claims, 6 Drawing Sheets

(56) References Cited

U.S. PATENT DOCUMENTS

| | | | | |
|---|---|---|---|---|
| 2010/0088919 | A1* | 4/2010 | Yang | F24F 1/06 34/202 |
| 2011/0072678 | A1* | 3/2011 | Chang | F26B 9/003 34/91 |
| 2016/0115644 | A1* | 4/2016 | Cho | D06F 58/20 34/212 |
| 2021/0123182 | A1* | 4/2021 | Castello | A45C 5/03 |
| 2021/0269966 | A1* | 9/2021 | Castello | B05B 16/20 |

FOREIGN PATENT DOCUMENTS

| | | | | |
|---|---|---|---|---|
| KR | 101321527 | B1 * | 10/2013 | D06F 58/20 |
| WO | WO-2014157953 | A1 * | 10/2014 | D06F 58/20 |

* cited by examiner

SUITCASE-INTEGRATED DRYING SYSTEM

FIELD OF THE INVENTION

The present invention generally relates to drying systems. More specifically, the present invention is a suitcase-integrated drying system that dries several articles of clothing and is portable with a suitcase.

BACKGROUND OF THE INVENTION

Travel is a thriving industry that costs consumers plenty of money. From bag fees, to ticket prices to random airport purchases, travel costs can accumulate quickly. It is important to pack the essentials and be well prepared for any needs and emergencies.

The present invention serves to account for one of the most common emergencies and needs during travel, which is wet clothing. Whether clothing gets wet from getting spilled on, rained on, or from being washed, there is quick and easy way to dry clothing. The present invention provides a compact and portable resource to dry clothing by utilizing an existing suitcase. The present invention allows other items to be stored with the suitcase as well and is removable from the suitcase in the event a traveler would like to have more space for storage within the suitcase. The present invention allows clothing to be hung from a frame in order to quickly and evenly dry clothing. The present invention may easily be powered by connecting to the nearest available outlet. The present invention remains lightweight and compact throughout travel.

DETAIL DESCRIPTIONS OF THE INVENTION

Figure 1:
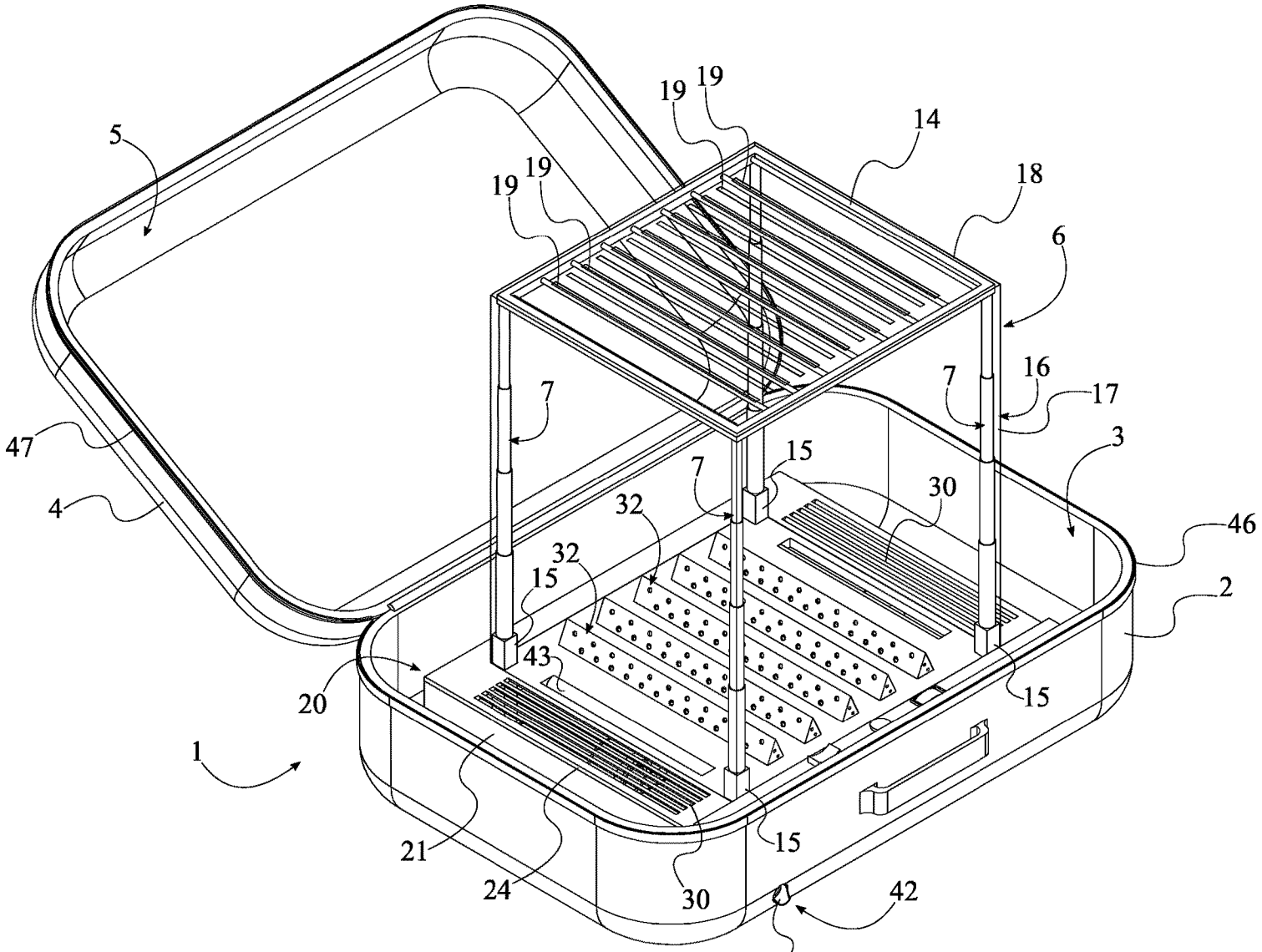
FIG. 1 is a perspective view of a first embodiment of the present invention with a plurality of nesting tubes and a plurality of settings upholding a frame for a rack system.
Figure 2:
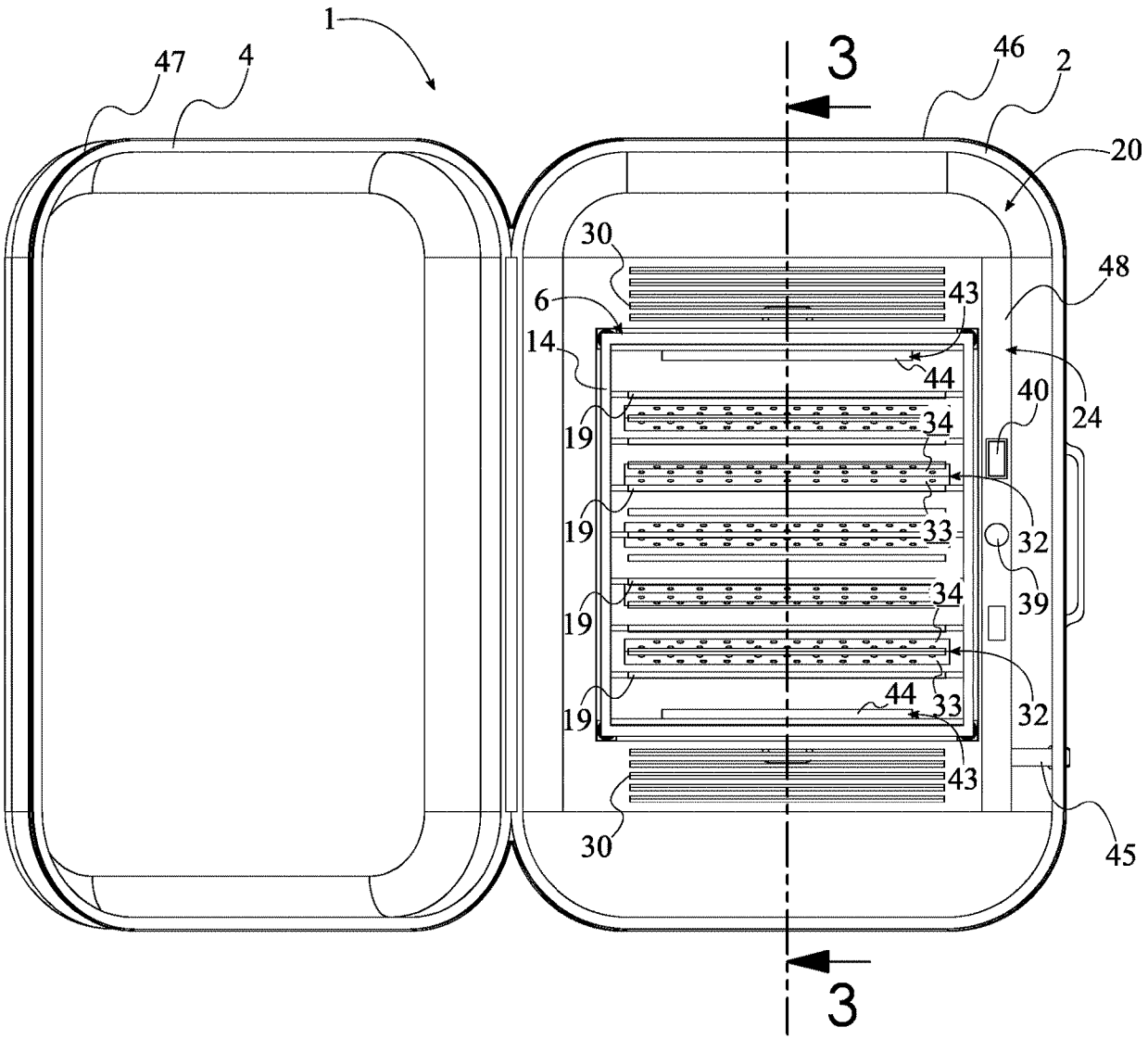
FIG. 2 is a top side view of the present invention.

All illustrations of the drawings are for the purpose of describing selected versions of the present invention and are not intended to limit the scope of the present invention.

The present invention is a suitcase-integrated drying system that allows a user to dry several garments throughout travel. The present invention is portable and compact. The user may easily dry clothing that may have been washed elsewhere or simply clothing that has been spilled on or gotten wet while traveling in a variety of settings such as an airport or park. The present invention is also a universal travel accessory that may be incorporated into a variety of suitcases. In order for the present invention to be easily transportable while being able to effectively dry garments, the present invention comprises a rack system 6, a dryer system 20, and a drainage system 42, seen in FIG. 1, FIG. 2, FIG. 3, and FIG. 5. The rack system 6 suspends clothing above the dryer system 20 so that wet clothing dries faster and evenly. The rack system 6 comprises a plurality of support posts 7 and a frame 14 in order to support the clothing above the dryer system 20. Moreover, the plurality of support posts 7 extends and retracts the frame 14 from the receptacle 21, and the clothing hangs from the frame 14. The dryer system 20 directs heat towards the rack system 6, and consequently the wet clothing hanging from the rack system 6. In order to direct heat and provide heat for the clothing, the dryer system 20 comprises a receptacle 21, a cover tray 24, at least one heater 25, at least one inlet 30, and a plurality of first ventilation slots 31. The receptacle 21 contains and positions the at least one heater 25 within the base casing 2. The receptacle 21 also contains the heated air being outputted by the at least one heater 25, which is directed with the plurality of first ventilation slots 31 through the cover tray 24. In order to uphold the cover tray 24 and contain the heated air, the receptacle 21 comprise a base wall 22 and a lateral wall 23. The base wall 22 presses against the base casing 2 and the lateral wall 23 surrounds the base wall 22. The cover tray 24 houses the heated air within the receptacle 21, and the plurality of first ventilation slots 31 direct the heated air towards the clothing hanging from the frame 14. The at least one heater 25 is able to output heated air as the at least one inlet 30 provides the necessary air flow within the environment defined by the receptacle 21 and the cover tray 24. While the clothing hanging from the frame 14 is drying with the dryer system 20, the drainage system 42 collects and directs any drippings that has fallen from the clothing, onto the cover tray 24, and out of both the receptacle 21 and the suitcase 1.

Figure 3:
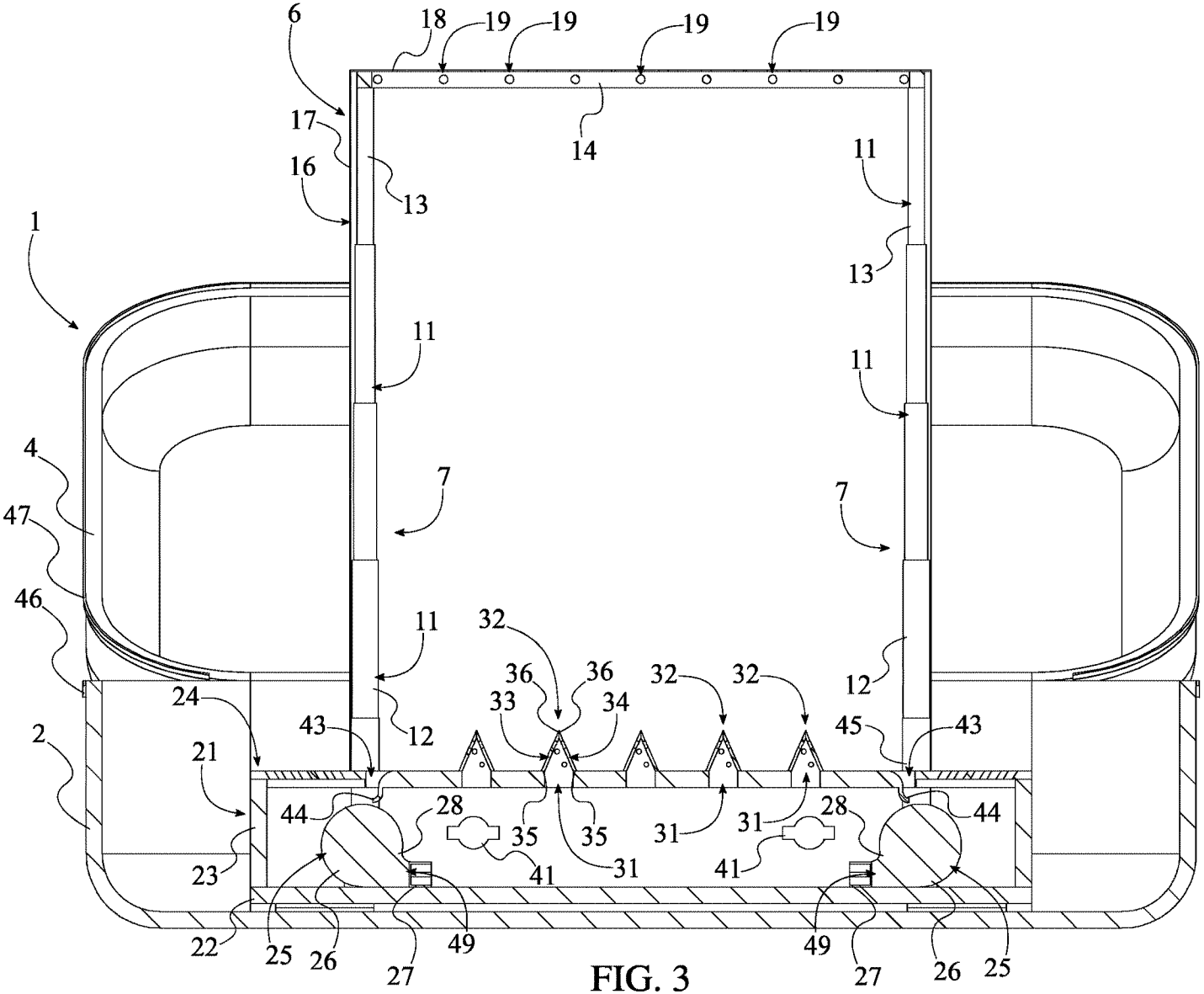
FIG. 3 is a cross-section view of FIG. 2 along line 3-3 of the present invention.

The overall configuration of the aforementioned components allows heated air to be directed towards clothing hanging with the present invention in order to facilitate the drying of wet clothing. In order for the receptacle 21 to house the at least one heater 25 and contain the heated air, the lateral wall 23 is perimetrically attached to the base wall 22, seen in FIG. 1 and FIG. 3. The cover tray 24 is positioned adjacent to the lateral wall 23, positioned opposite to the base wall 22, effectively housing the at least one heater 25 and containing the heated air. More specifically, the cover tray 24 is perimetrically connected with the lateral wall 23. As shown in FIG. 3, the at least one heater 25 is positioned within the receptacle 21 so that the environment defined by the receptacle 21 and the cover tray 24 may output heated air through the plurality of first ventilation slots 31 to the clothing. The heated air is directly applied towards the clothing hanging from the frame 14 with the at least one heater 25 as the at least one inlet 30 and the plurality of first ventilation slots 31 traverse through the cover tray 24. The plurality of first ventilation slots 31 is distributed across the cover tray 24, evenly directing heated air across the frame 14 with the hanging clothing. The at least one inlet 30 is peripherally positioned on the cover tray 24 in order define a continuous flow of air into and out of the environment defined by receptacle 21 and the cover tray 24. The at least one inlet 30 is in fluid communication with the plurality of first ventilation slots 31 through the at least one heater 25, thereby not only heating air within the receptacle 21 and cover tray 24 but effectively directly heated air through the plurality of first ventilation slots 31. In order to collect and direct any drippings that may have fallen off of the clothing hanging from the frame 14, the drainage system 42 is integrated into the cover tray 24, the receptacle 21, and the suitcase 1. The frame 14 is operatively coupled with the receptacle 21 with the plurality of support posts 7, wherein the plurality of support posts 7 is used to extend the frame 14 from the base wall 22 and to retract the frame 14 towards the base wall 22. This arrangement allows the frame 14 to securely uphold several garments while being compact throughout transportation. In the preferred embodiment of the present invention, the frame 14 rest on the cover tray 24 while in a retracted configuration. However, the cover tray 24 may also be removed from the receptacle 21 and the frame 14 may be positioned within the receptacle 21 and housed with the cover tray 24 throughout transportation.

In order for the present invention to be easily transportable, the present invention further comprises a suitcase 1, seen in FIG. 1, FIG. 2, FIG. 3, FIG. 4, and FIG. 5. The suitcase 1 contains a variety of items, such as clothing, toiletries, and accessories, that are essential for travel and a destination. The suitcase 1 protects these items as well as the rack system 6, the dryer system 20, and the drainage system 42. In order to uphold the dryer system 20, and consequently the rack system 6 and the drainage system 42, the suitcase 1 comprises a base casing 2 and a cover casing 4 so that the suitcase 1 is able to contain a variety of items and protect a variety of items, along with the rack system 6, the dryer system 20, and the drainage system 42. The present invention further comprises a first elongated fastener 46 and a second elongated fastener 47 so that the cover casing 4 along with the base casing 2 securely houses a variety of transportable items and a user is able to access these items. The first elongated fastener 46 and the second elongated fastener 47 are preferably a couple of corresponding zipper tracks. However, it is understood that a variety of fasteners may be utilized to securely connect the base casing 2 with the cover casing 4. An opening 3 of the base casing 2 is positioned adjacent an opening 5 of the cover casing 4, allowing items to be positioned within the suitcase 1. Moreover, the cover casing 4 is coextensive with the base casing 2. The base wall 22 is connected within the base casing 2 so that the remainder of the suitcase 1 may be utilized for storage of a variety of items and the present invention is portable with the suitcase 1. In the preferred embodiment of the present invention, the base wall 22 is connected to the base wall 22 with a plurality of hook-and-loop strips (e.g. Velcro) that are removably attached to both the base wall 22 and the base casing 2 with adhesive layers. The plurality of hook-and-loop strips allows the base wall 22 to be attached and separated from the base casing 2 so that the receptacle 21 may be interchanged or removed from the suitcase 1. The suitcase 1 securely houses items within the base casing 2 and the cover casing 4 as the first elongated fastener 46 is perimetrically connected about the opening 3 of the base casing 2. Similarly, the second elongated fastener 47 is perimetrically connected about the opening 5 of the cover casing 4. The user may open and close the suitcase 1 as the first elongated fastener 46 is removably attached to the second elongated fastener 47.

In order to facilitate the drying of clothing hanging from the frame 14 of the rack system 6, the dryer system 20 further comprises a plurality of perforated covers 32, seen in FIG. 1, FIG. 2, FIG. 3, and FIG. 5. The plurality of perforated covers 32 effectively directs heated air towards the clothing without dismounting the clothing from the frame 14 as a result of powerful gusts of heated air escaping through the plurality of first ventilation slots 31. The plurality of perforated covers 32 is mounted onto the cover tray 24, opposite the receptacle 21, and each of the plurality of perforated covers 32 is positioned across a corresponding slot from the plurality of first ventilation slots 31, guiding the heated air through the plurality of first ventilation holes. The at least one heater 25 is positioned adjacent to the at least one inlet 30 and is oriented away from the at least one inlet 30. The at least one heater 25 is able to harness air from outside of the environment of defined by the receptacle 21 and the cover tray 24 in order to provide a continuous flow of heated air through the plurality of first ventilation slots 31.

In the preferred embodiment of the present invention, each of the plurality of perforated covers 32 comprises a first plate 33 and a second plate 34, and the first plate 33 and the second plate 34 each comprise a proximal lengthwise edge 35 and a distal lengthwise edge 36, seen in FIG. 3. The first plate 33 and the second plate 34 maximize the distribution of heated air across the frame 14 and along the clothing hanging from the frame 14. The proximal lengthwise edge 35 is positioned adjacent to the cover tray 24, and the distal lengthwise edge 36 is positioned offset from the cover tray 24. In order to define a pyramid-like configuration with the first plate 33 and the second plate 34, the proximal lengthwise edge 35 of the first plate 33 is fixed along the proximal lengthwise edge 35 of the second plate 34. Moreover, the distal lengthwise edge 36 of the first plate 33 is positioned offset from the distal lengthwise edge 36 of the second plate 34.

In order to effectively collect any drippings from the clothing hanging from the frame 14, the drainage system 42 comprises at least one drainage slot 43, at least one elongated shield 44, and an outlet spout 45, seen in FIG. 3. The at least one drainage slot 43 collects drippings that have fallen from the wet clothing and onto the cover tray 24. The at least one elongated shield 44 directs the drippings away from the flow of heated air outputted from the at least one heater 25. The outlet spout 45 collects and directs the drippings that have fallen through the at least one drainage slot 43, from the at least one elongated shield 44, and into the receptacle 21, out of the receptacle 21 and out of the suitcase 1. The at least one drainage slot 43 traverses through the cover tray 24 and is positioned in between the at least one inlet 30 and the at least one heater 25. The drippings are not blown back up towards the clothing hanging from the frame 14 as the at least one elongated shield 44 is positioned along the at least one drainage slot 43 and is fixed onto the cover tray 24. More specifically, the at least one elongated shield 44 is positioned between the cover tray 24 and the receptacle 21 and is oriented away from the plurality of first ventilation slots 31. This arrangement ensures the clothing remains dry and allows the receptacle 21 to contain any drippings, preserving the integrity of the suitcase 1 as well. The outlet spout 45 is externally mounted to the lateral wall 23 of the receptacle 21 and traverses through the base casing 2 of the suitcase 1. The drippings are properly expelled from both the receptacle 21 and the suitcase 1 and may be collected with a tube and a variety of other attachments. The at least one elongated shield 44 is in fluid communication with the outlet spout 45 through the receptacle 21, allowing the present invention to remain portable and compact throughout use while keeping the suitcase 1 dry throughout the drying process.

The user operates the at least one heater 25 as the dryer system 20 further comprises a microcontroller 37, a power source 38, a power button 39, and a control dial 40, seen in FIG. 1, FIG. 2, FIG. 5, and FIG. 6. The microcontroller 37 controls the power source 38 as well as receives and processes inputs from both the power button 39 and the control dial 40. The power source 38 provides the necessary power for the at least one heater 25, the microcontroller 37, the power button 39, and the control dial 40. The power source 38 is preferably an outlet that is connected with the present invention with a power cord or power cable. The power button 39 turns on and turns off the at least one heater 25. The control dial 40 adjusts the intensity of the at least one heater 25. Alternate embodiments of the present invention may comprise a first control dial 40 and a second control dial 40 that adjusts the strength of the airflow from the at least one heater 25 and the temperature of the at least one heater 25, respectively. In order to for the at least one heater 25, the power source 38, the power button 39, and the control dial 40 to communicate with one another, the microcontroller 37 is electronically connected with the at least one heater 25, the power source 38, the power button 39, and the control dial 40. The power source 38 is electrically connected with the microcontroller 37 and the at least one heater 25, providing the necessary power for both the microcontroller 37 and the at least one heater 25 to operate. The present invention remains portable as microcontroller 37 is integrated within the lateral wall 23 of the receptacle 21. The overall weight of the present invention remains light as the power source 38 is externally positioned with the receptacle 21 and the suitcase 1. This arrangement also allows the present invention to be connected to a power source 38 with a sufficient power supply needed to effectively and continuously provide power for the microcontroller 37 and the at least one heater 25. It is understood that in various embodiments may comprise a portable power source 38 that is able to be stored within the suitcase 1. The user is able to easily operate and adjust the at least one heater 25 as the power button 39 and the control dial 40 are mounted onto a rim 48 of the cover tray 24, positioned opposite to the lateral wall 23.

Figure 5:
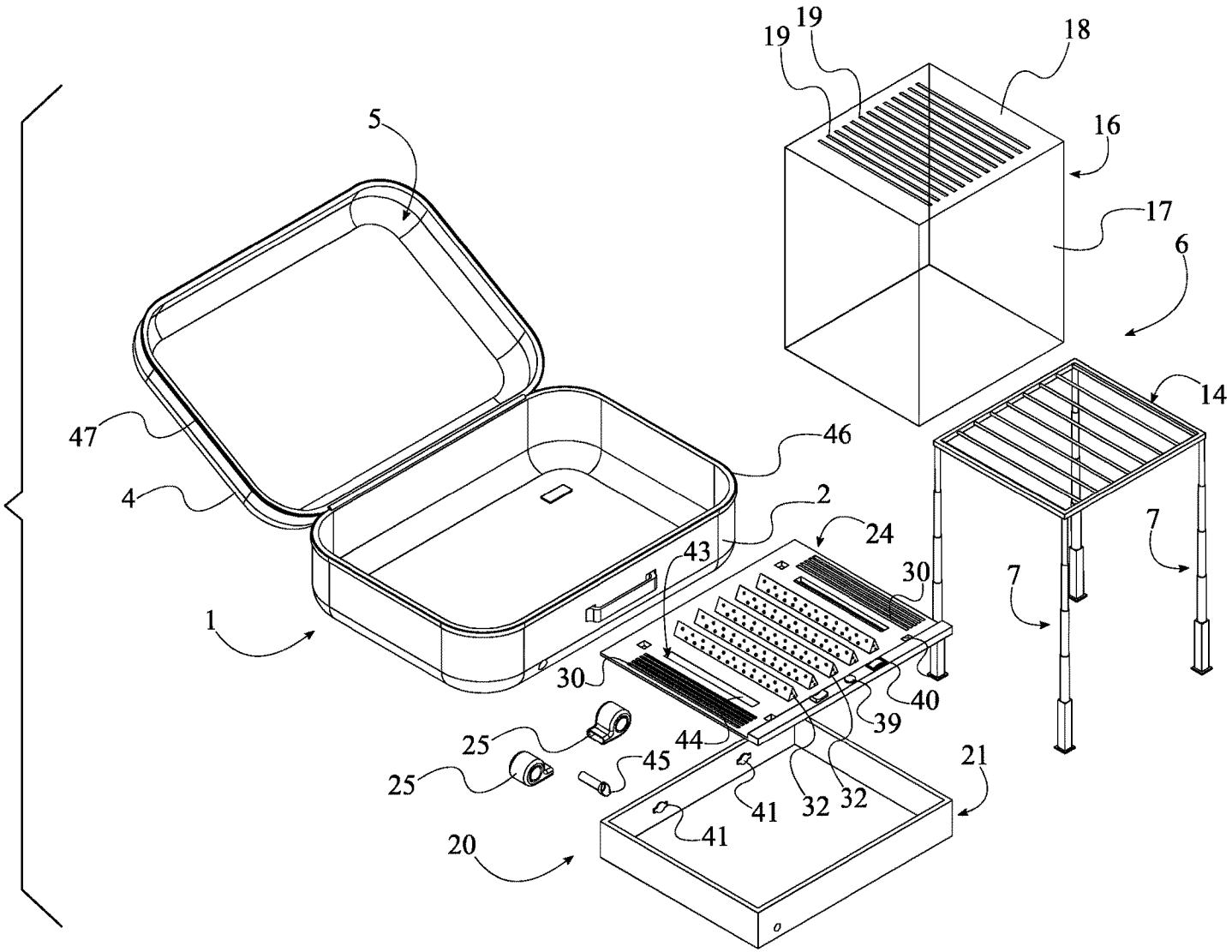
FIG. 5 is an exploded view of the present invention.
Figure 6:
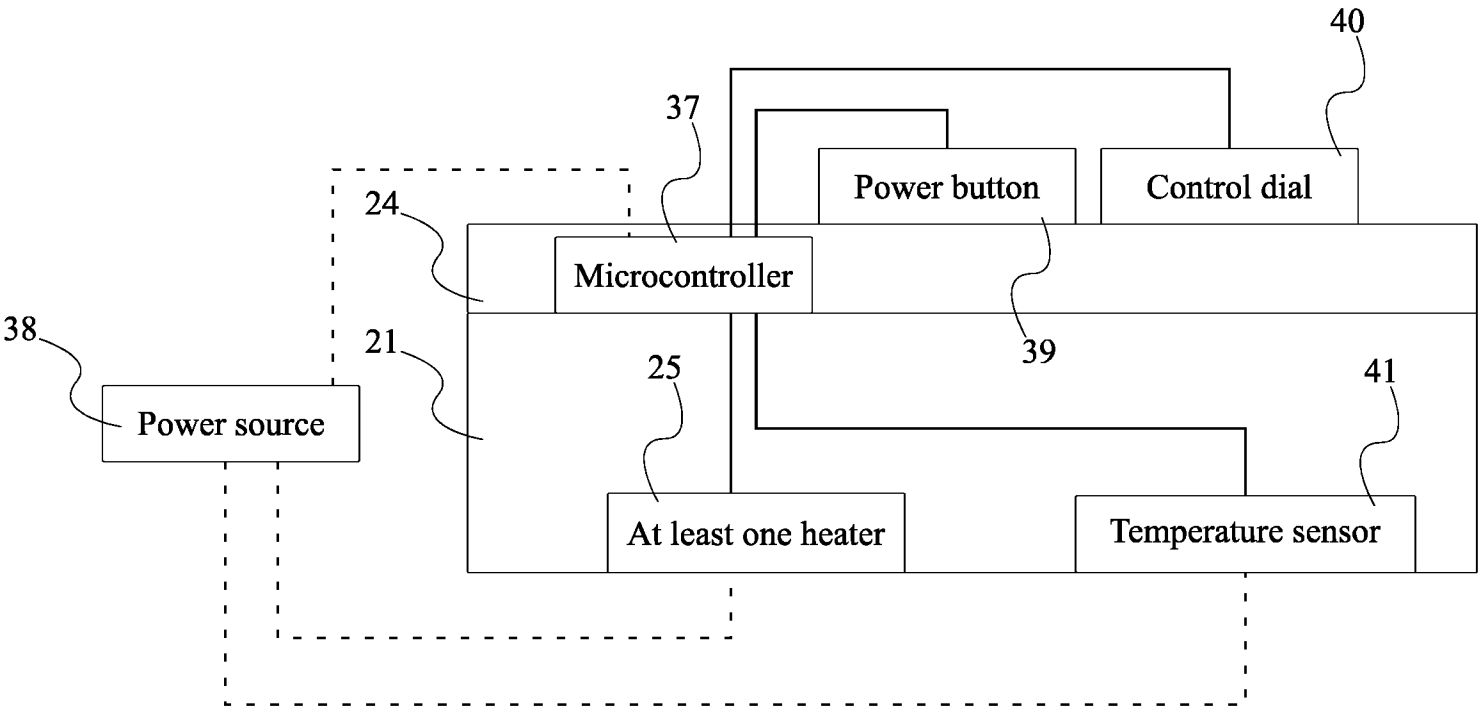
FIG. 6 is a schematic view of the electronic connections of the present invention.

In order to ensure the safety of the present invention, the dryer system 20 further comprises a temperature sensor 41, seen in FIG. 5 and FIG. 6. The temperature sensor 41 monitors the current temperature within the environment defined by the receptacle 21 and the cover tray 24. If the current temperature exceeds a specific temperature that will damage the receptacle 21, the cover tray 24, the suitcase 1, and the clothing hanging from the frame 14, the at least one heater 25 automatically turns off. The temperature sensor 41 is positioned within the receptacle 21 to be able to detect the current temperature. The microcontroller 37 is electronically connected with the temperature sensor 41 so that the microcontroller 37 automatically turns off the at least one heater 25 if the current temperature exceeds a specific high temperature. The power source 38 provides the necessary power for the temperature sensor 41 to operate as the power source 38 is electrically connected with the temperature sensor 41 as well.

The at least one heater 25 is able to both heat the environment within the receptacle 21 and the cover tray 24 and blow air towards the rack system 6 and the clothing hanging from the frame 14 of the rack system 6 as the at least one heater 25 comprises both a blower 26 and a heating element 27, seen in FIG. 3. The blower 26 facilitates air flow from the at least one inlet 30 and through the plurality of first ventilation slots 31. The heating element 27 raises the temperature of the air being outputted from the blower 26. The blower 26 is connected with the base wall 22, and the heating element 27 is connected into an outlet 49 of the blower 26. This arrangement ensures that all the air blown from the blower 26 is hot, forcing the clothing to dry even faster. The outlet of the blower 26 is oriented away from the lateral wall 23 of the receptacle 21, defining a continuous and smooth flow of air out of the receptacle 21 and the cover tray 24, through the plurality of first ventilation slots 31, and towards the clothing hanging from the frame 14. In the preferred embodiment of the present invention, the at least one heater 25 comprises a first heater 28 and a second heater 29. The first heater 28 and the second heater 29 effectively dry clothing along a larger suitcase 1. The first heater 28 is positioned opposite the second heater 29 across the receptacle 21 and are oriented towards each other.

In first embodiment of the present invention, the rack system 6 further comprises a plurality of settings 15, and each of the plurality of support posts 7 comprises a plurality of nesting tubes 11, seen in FIG. 1 and FIG. 3. The plurality of settings 15 and the plurality of nesting tubes 11 uphold the frame 14 and support the weight of the frame 14 and the clothing hanging from the frame 14. Each of the plurality of nesting tubes 11 comprises a proximal tube 12 and a distal tube 13. The plurality of settings 15 is peripherally distributed around the base wall 22 in order to balance the frame 14 above the receptacle 21 and the cover tray 24. The proximal tube 12 from each of the plurality of support posts 7 is mounted onto the base wall 22 by a corresponding setting from the plurality of settings 15, stabilizing the plurality of nesting tubes 11 with the receptacle 21. The plurality of nesting tubes 11 is telescopically engaged to each other, allowing the plurality of support posts 7 to extend and retract. The distal tube 13 from each of the plurality of support posts 7 is mounted against the frame 14, preserving the structural integrity of the frame 14 and the overall rack system 6.

Figure 4:
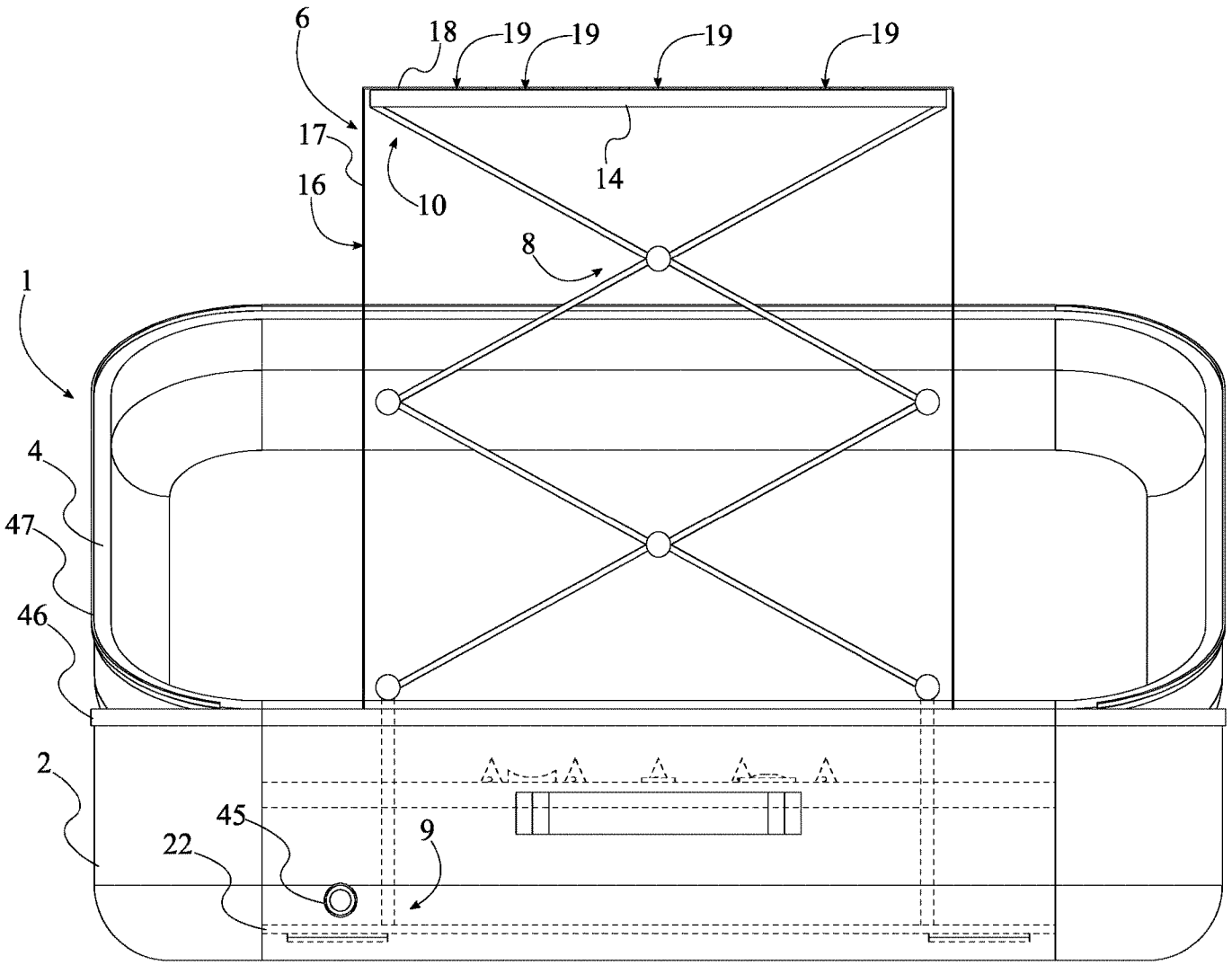
FIG. 4 is a side view of a second embodiment of the present invention with a scissor-lift mechanism.

In a second embodiment of the present invention, the plurality of support posts 7 is arranged into a scissor-lift mechanism 8, seen in FIG. 4. The scissor-lift mechanism 8 supports and upholds larger weights that the plurality of support posts 7 of the first embodiment may not be able to support and uphold. The scissor-lift mechanism 8 comprises a proximal push end 9 and a distal push end 10. The proximal push end 9 uplifts the plurality of support posts 7. The distal push end 10 uplifts the frame 14. The proximal push end 9 is mounted onto the base wall 22, and the distal push end 10 is mounted against the frame 14, structurally supporting the frame 14 the clothing from the frame 14.

In order to dry the clothing hanging from the frame 14 even faster, the rack system 6 further comprises a rack cover 16 and a plurality of second ventilation slots 19, seen in FIG. 1, FIG. 3, and FIG. 5. The rack cover 16 contains the heated air around the frame 14 and the plurality of support posts 7, and consequently the wet clothing hanging from the frame 14. The plurality of second ventilation slots 19 relieves the environment defined by the cover tray 24 and the rack cover 16 from overheating. The rack comprises a lateral portion 17 and a base portion 18. The lateral portion 17 surrounds the plurality of support posts 7, and the base portion 18 covers the frame 14. In the preferred embodiment of the present invention, a fastener is integrated along an edge of the lateral portion 17 in order to facilitate the attachment and removal of the rack cover 16 around the plurality of support posts 7 and the frame 14. Furthermore, the rack cover 16 of the preferred embodiment of the present invention is preferably transparent so that a user may see the clothing once completely dry. The lateral portion 17 is perimetrically fixed around the base portion 18 and, the plurality of support posts 7 and the frame 14 is positioned within the rack cover 16, defining an enclosure around the frame 14 and the plurality of support posts 7. Moreover, the lateral portion 17 is positioned around the plurality of support posts 7. Similarly, the base portion 18 is positioned adjacent to the frame 14, opposite the plurality of plurality of support posts 7. The continuous air flow is maintained with the rack cover 16 as the plurality of second ventilation slots 19 is distributed across the base portion 18 and traverses through the base portion 18.

Although the invention has been explained in relation to its preferred embodiment, it is to be understood that many other possible modifications and variations can be made without departing from the spirit and scope of the invention as hereinafter claimed.

What is claimed is:

1. A suitcase-integrated drying system for garments comprises:

a rack system;

a dryer system;

a drainage system;

the rack system comprises a plurality of support posts and a frame;

the dryer system comprises a receptacle, a cover tray, at least one heater, at least one inlet, and a plurality of first ventilation slots;

the receptacle comprises a base wall and a lateral wall;

the lateral wall being perimetrically attached to the base wall;

the cover tray being positioned adjacent to the lateral wall, positioned opposite to the base wall;

the cover tray being perimetrically connected with the lateral wall;

the at least one heater being positioned within the receptacle;

the at least one inlet and the plurality of first ventilation slots traversing through the cover tray;

the plurality of first ventilation slots being distributed across the cover tray;

the at least one inlet being peripherally positioned on the cover tray;

the at least one inlet being in fluid communication with the plurality of first ventilation slots through the at least one heater;

the drainage system being integrated into the cover tray, the receptacle, and a suitcase; and, the frame being operatively coupled with the receptacle with the plurality of support posts, wherein the plurality of support posts is used to extend the frame from the base wall and to retract the frame towards the base wall.

2. The suitcase-integrated drying system for garments as claimed in claim 1 comprises:

the suitcase;

a first elongated fastener;

a second elongated fastener;

the suitcase comprises a base casing and a cover casing;

an opening of the base casing being positioned adjacent an opening of the cover casing;

the cover casing being coextensive with the base casing;

the base wall being connected within the base casing;

the first elongated fastener being perimetrically connected about the opening of the base casing;

the second elongated fastener being perimetrically connected about the opening of the cover casing; and, the first elongated fastener being removably attached to the second elongated fastener.

3. The suitcase-integrated drying system for garments as claimed in claim 1 comprises:

the dryer system further comprises a plurality of perforated covers;

the plurality of perforated covers being mounted onto the cover tray, opposite the receptacle;

each of the plurality of perforated covers being positioned across a corresponding slot from the plurality of first ventilation slots;

the at least one heater being positioned adjacent to the at least one inlet; and, the at least one heater being oriented away from the at least one inlet.

4. The suitcase-integrated drying system for garments as claimed in claim 3 comprises:

each of the plurality of perforated covers comprises a first plate and a second plate;

the first plate and the second plate each comprise a proximal lengthwise edge and a distal lengthwise edge;

the proximal lengthwise edge being positioned adjacent to the cover tray;

the distal lengthwise edge being positioned offset from the cover tray;

the proximal lengthwise edge of the first plate being fixed along the proximal lengthwise edge of the second plate; and, the distal lengthwise edge of the first plate being positioned offset from the distal lengthwise edge of the second plate.

5. The suitcase-integrated drying system for garments as claimed in claim 1 comprises:

the drainage system comprises at least one drainage slot, at least one elongated shield, and an outlet spout;

the base wall being connected within the base casing;

the at least one drainage slot traversing through the cover tray;

the at least one drainage slot being positioned in between the at least one inlet and the at least one heater;

the at least one elongated shield being positioned along the at least one drainage slot;

the at least one elongated shield being fixed onto the cover tray;

the at least one elongated shield being positioned between the cover tray and the receptacle;

the at least one elongated shield being oriented away from the plurality of first ventilation slots;

the outlet spout being externally mounted to the lateral wall of the receptacle; and, the at least one elongated shield being in fluid communication with the outlet spout through the receptacle.

6. The suitcase-integrated drying system for garments as claimed in claim 5 comprises:

the suitcase;

the suitcase comprises a base casing;

the base wall being connected within the base casing; and, the outlet spout traversing through the base casing.

7. The suitcase-integrated drying system for garments as claimed in claim 1 comprises:

the dryer system further comprises a microcontroller, a power source, a power button, and a control dial;

the microcontroller being electronically connected with the at least one heater, the power source, the power button, and the control dial;

the power source being electrically connected with the microcontroller and the at least one heater;

the microcontroller being integrated within the lateral wall of the receptacle;

the power source being externally positioned with the receptacle and the suitcase; and, the power button and the control dial being mounted onto a rim of the cover tray, positioned opposite to the lateral wall.

8. The suitcase-integrated drying system for garments as claimed in claim 7 comprises:

the dryer system further comprises a temperature sensor;

the temperature sensor being positioned within the receptacle and the cover tray;

the microcontroller being electronically connected with the temperature sensor; and, the power source being electrically connected with the temperature sensor.

9. The suitcase-integrated drying system for garments as claimed in claim 1 comprises:

the at least one heater comprises a blower and a heating element;

the blower being connected with the base wall;

the heating element being connected into an outlet of the blower; and, the outlet of the blower being oriented away from the lateral wall of the receptacle.

10. The suitcase-integrated drying system for garments as claimed in claim 1 comprises:

the at least one heater comprises a first heater and a second heater;

the first heater being positioned opposite the second heater across the receptacle; and, the first heater and the second heater being oriented towards each other.

11. The suitcase-integrated drying system for garments as claimed in claim 1 comprises:

the rack system further comprises a plurality of settings;

each of the plurality of support posts comprises a plurality of nesting tubes;

each of the plurality of nesting tubes comprises a proximal tube and a distal tube;

the plurality of settings being peripherally distributed around the base wall;

the proximal tube from each of the plurality of support posts being mounted onto the base wall by a corresponding setting from the plurality of settings;

the plurality of nesting tubes being telescopically engaged to each other; and, the distal tube from each of the plurality of support posts being mounted against the frame.

12. The suitcase-integrated drying system for garments as claimed in claim 1 comprises:

the plurality of support posts being arranged into a scissor-lift mechanism;

the scissor-lift mechanism comprises a proximal push end and a distal push end;

the proximal push end being mounted onto the base wall; and, the distal push end being mounted against the frame.

13. The suitcase-integrated drying system for garments as claimed in claim 1 comprises:

the rack system further comprises a rack cover and a plurality of second ventilation slots;

the rack cover comprises a lateral portion and a base portion;

the lateral portion being perimetrically fixed around the base portion;

the plurality of support posts and the frame being positioned within the rack cover;

the lateral portion being positioned around the plurality of support posts;

the base portion being positioned adjacent to the frame, opposite the plurality of support posts;

the plurality of second ventilation slots being distributed across the base portion; and, the plurality of second ventilation slots traversing through the base portion.

14. A suitcase-integrated drying system for garments comprises:

a rack system;

a dryer system;

a drainage system;

the rack system comprises a plurality of support posts, a frame, a rack cover and a plurality of second ventilation slots;

the dryer system comprises a receptacle, a cover tray, at least one heater, at least one inlet, and a plurality of first ventilation slots;

the receptacle comprises a base wall and a lateral wall;

the at least one heater comprises a blower, a heating element, a first heater, and a second heater;

the rack cover comprises a lateral portion and a base portion the lateral wall being perimetrically attached to the base wall;

the cover tray being positioned adjacent to the lateral wall, positioned opposite to the base wall;

the cover tray being perimetrically connected with the lateral wall;

the at least one heater being positioned within the receptacle;

the at least one inlet and the plurality of first ventilation slots traversing through the cover tray;

the plurality of first ventilation slots being distributed across the cover tray;

the at least one inlet being peripherally positioned on the cover tray;

the at least one inlet being in fluid communication with the plurality of first ventilation slots through the at least one heater;

the drainage system being integrated into the cover tray, the receptacle, and a suitcase;

the frame being operatively coupled with the receptacle with the plurality of support posts, wherein the plurality of support posts is used to extend the frame from the base wall and to retract the frame towards the base wall;

the blower being connected with the base wall;

the heating element being connected into an outlet of the blower;

the outlet of the blower being oriented away from the lateral wall of the receptacle;

the first heater being positioned opposite the second heater across the receptacle;

the first heater and the second heater being oriented towards each other;

the lateral portion being perimetrically fixed around the base portion;

the plurality of support posts and the frame being positioned within the rack cover;

the lateral portion being positioned around the plurality of support posts;

the base portion being positioned adjacent to the frame, opposite the plurality of support posts;

the plurality of second ventilation slots being distributed across the base portion; and, the plurality of second ventilation slots traversing through the base portion.

15. The suitcase-integrated drying system for garments as claimed in claim 14 comprises:

the suitcase;

a first elongated fastener;

a second elongated fastener;

the suitcase comprises a base casing and a cover casing;

an opening of the base casing being positioned adjacent an opening of the cover casing;

the cover casing being coextensive with the base casing;

the base wall being connected within the base casing;

the first elongated fastener being perimetrically connected about the opening of the base casing;

the second elongated fastener being perimetrically connected about the opening of the cover casing; and, the first elongated fastener being removably attached to the second elongated fastener.

16. The suitcase-integrated drying system for garments as claimed in claim 14 comprises:

the dryer system further comprises a plurality of perforated covers;

each of the plurality of perforated covers comprises a first plate and a second plate;

the first plate and the second plate each comprise a proximal lengthwise edge and a distal lengthwise edge;

the plurality of perforated covers being mounted onto the cover tray, opposite the receptacle;

each of the plurality of perforated covers being positioned across a corresponding slot from the plurality of first ventilation slots;

the at least one heater being positioned adjacent to the at least one inlet;

the at least one heater being oriented away from the at least one inlet;

the proximal lengthwise edge being positioned adjacent to the cover tray;

the distal lengthwise edge being positioned offset from the cover tray;

the proximal lengthwise edge of the first plate being fixed along the proximal lengthwise edge of the second plate; and, the distal lengthwise edge of the first plate being positioned offset from the distal lengthwise edge of the second plate.

17. The suitcase-integrated drying system for garments as claimed in claim 14 comprises:

the suitcase;

the drainage system comprises at least one drainage slot, at least one elongated shield, and an outlet spout;

the suitcase comprises a base casing;

the base wall being connected within the base casing;

the at least one drainage slot traversing through the cover tray;

the at least one drainage slot being positioned in between the at least one inlet and the at least one heater;

the at least one elongated shield being positioned along the at least one drainage slot;

the at least one elongated shield being fixed onto the cover tray;

the at least one elongated shield being positioned between the cover tray and the receptacle;

the at least one elongated shield being oriented away from the plurality of first ventilation slots;

the outlet spout being externally mounted to the lateral wall of the receptacle;

the outlet spout traversing through the base casing; and, the at least one elongated shield being in fluid communication with the outlet spout through the receptacle.

18. The suitcase-integrated drying system for garments as claimed in claim 14 comprises:

the dryer system further comprises a microcontroller, a power source, a power button, a control dial, and a temperature sensor;

the microcontroller being electronically connected with the at least one heater, the power source, the power button, the control dial, and temperature sensor;

the power source being electrically connected with the microcontroller, the at least one heater, and the temperature sensor;

the microcontroller being integrated within the lateral wall of the receptacle;

the temperature sensor being positioned within the receptacle and the cover tray;

the power source being externally positioned with the receptacle and the suitcase; and, the power button and the control dial being mounted onto a rim of the cover tray, positioned opposite to the lateral wall.

19. The suitcase-integrated drying system for garments as claimed in claim 14 comprises:

the rack system further comprises a plurality of settings;

each of the plurality of support posts comprises a plurality of nesting tubes;

each of the plurality of nesting tubes comprises a proximal tube and a distal tube;

the plurality of settings being peripherally distributed around the base wall;

the proximal tube from each of the plurality of support posts being mounted onto the base wall by a corresponding setting from the plurality of settings;

the plurality of nesting tubes being telescopically engaged to each other; and, the distal tube from each of the plurality of support posts being mounted against the frame.

20. The suitcase-integrated drying system for garments as claimed in claim 14 comprises:

the plurality of support posts being arranged into a scissor-lift mechanism;

the scissor-lift mechanism comprises a proximal push end and a distal push end;

the proximal push end being mounted onto the base wall; and, the distal push end being mounted against the frame.

* * * * *